US010449399B2

(12) United States Patent
Patton

(10) Patent No.: US 10,449,399 B2
(45) Date of Patent: Oct. 22, 2019

(54) HORIZONTAL LIFELINE SYSTEM AND METHOD OF ADJUSTING A HORIZONTAL LIFELINE SYSTEM

(71) Applicant: WERNER CO., Greenville, PA (US)

(72) Inventor: Justin S. Patton, Franklin, PA (US)

(73) Assignee: WERNER CO., Greenville, PA (US)

( * ) Notice: Subject to any disclaimer, the term of this patent is extended or adjusted under 35 U.S.C. 154(b) by 5 days.

(21) Appl. No.: 15/704,528

(22) Filed: Sep. 14, 2017

(65) Prior Publication Data

US 2019/0076681 A1 Mar. 14, 2019

(51) Int. Cl.
*A62B 35/00* (2006.01)
*A62B 35/04* (2006.01)

(52) U.S. Cl.
CPC ..... *A62B 35/0056* (2013.01); *A62B 35/04* (2013.01)

(58) Field of Classification Search
CPC ..... A62B 35/0056; A62B 35/04
See application file for complete search history.

(56) References Cited

U.S. PATENT DOCUMENTS 3,302,931 A 2/1967 Blackburn
3,861,215 A * 1/1975 Bradley ..... A63B 21/015 482/116
4,353,150 A * 10/1982 Docken ..... B25B 25/00 24/68 CD
5,332,071 A * 7/1994 Duncan ..... A62B 35/04 188/371
5,458,214 A 10/1995 Olson et al.
5,522,472 A 6/1996 Shuman, Jr. et al.
(Continued)

FOREIGN PATENT DOCUMENTS

FR 2 981 854 A1 5/2013
GB 2 389 386 A 12/2003
(Continued)

OTHER PUBLICATIONS

Spanset Inc., http://www.spanset-wind.com/static/pdf/windenergy/Fall%20Protection%20Catalog.pdf, 2016, 34 pp.
(Continued)

*Primary Examiner* — Alvin C Chin-Shue
*Assistant Examiner* — Candace L Bradford
(74) *Attorney, Agent, or Firm* — Eckert Seamans Cherin & Mellott, LLC

(57) ABSTRACT

A horizontal lifeline system includes a first termination arrangement structured to attach to a first anchor point, a second termination arrangement structured to attach to a second anchor point, a horizontal lifeline cable coupled to the first termination arrangement, a rope length adjuster attached to the horizontal lifeline cable and having a housing through which the horizontal lifeline cable can be pulled to adjust the length of the horizontal lifeline system and apply tension to the horizontal lifeline cable, and a tension limiting ratchet coupled between the second termination arrangement and the rope length adjuster and being structured to be ratcheted to increase tension applied to the horizontal lifeline cable and to provide an indication and deter further ratcheting when the tension applied to the horizontal lifeline cable reaches a predetermined tension limit.

14 Claims, 5 Drawing Sheets

(56) References Cited

U.S. PATENT DOCUMENTS

| | | | | |
|---|---|---|---|---|
| 5,598,900 | A * | 2/1997 | O'Rourke | A62B 35/0056 182/18 |
| 5,957,432 | A * | 9/1999 | Ostrobrod | A62B 35/0056 254/368 |
| 6,311,625 | B1 * | 11/2001 | Ostrobrod | A62B 35/0056 104/91 |
| 6,446,936 | B1 * | 9/2002 | Ostrobrod | A62B 35/0056 254/368 |
| 6,581,725 | B2 * | 6/2003 | Choate | A62B 35/0056 182/3 |
| 6,779,630 | B2 * | 8/2004 | Choate | A62B 35/0056 182/36 |
| 6,945,356 | B2 | 9/2005 | Luke et al. | |
| 7,048,090 | B2 * | 5/2006 | Dean | A62B 35/0056 182/3 |
| 7,950,629 | B2 | 5/2011 | Mamie | |
| 8,192,331 | B2 | 6/2012 | Colombo et al. | |
| 9,162,605 | B2 * | 10/2015 | Durand | B60P 7/083 |
| 9,387,384 | B2 | 7/2016 | Mehr | |
| 9,480,865 | B2 * | 11/2016 | Naylor | A62B 35/00 |
| 2002/0053485 | A1 * | 5/2002 | Reynolds | A62B 35/0056 182/3 |
| 2004/0055818 | A1 * | 3/2004 | Fulton | A62B 35/0056 182/3 |
| 2005/0280297 | A1 * | 12/2005 | Patterson | B60N 2/002 297/217.4 |
| 2011/0103558 | A1 * | 5/2011 | Hooten | A62B 35/04 379/37 |
| 2012/0298446 | A1 * | 11/2012 | Meillet | A62B 35/0093 182/15 |
| 2016/0347233 | A1 * | 12/2016 | Kingery | B60P 7/083 |

FOREIGN PATENT DOCUMENTS

| | | |
|---|---|---|
| GB | 2 420 820 A | 6/2006 |
| WO | 2008/057124 A1 | 5/2008 |

OTHER PUBLICATIONS

Spanset Inc., http://www.relsafe.com/catalog.pdf, 2009, 64 pp.

* cited by examiner

HORIZONTAL LIFELINE SYSTEM AND METHOD OF ADJUSTING A HORIZONTAL LIFELINE SYSTEM

BACKGROUND

Field

The disclosed concept relates generally to fall protection systems, and in particular, to horizontal lifeline systems. The disclosed concept also pertains to methods of adjusting a horizontal lifeline system

Background Information

In fall protection systems, a worker typically wears a safety harness. In some fall protection systems, the safety harness is attached to a horizontal lifeline system via a lanyard or another attachment mechanism. Horizontal lifeline systems typically span horizontally between attachment points such as anchors in a structure. In an arrest situation, such as when a worker falls, the horizontal lifeline system will deploy to slow and stop the fall of the worker. Horizontal lifeline systems often include an energy absorber that deploys in an arrest situation to slow the fall of the worker.

The end to end length of the horizontal lifeline system should be about equal to the distance between the points it is anchored to. However, horizontal lifeline systems are often used in a variety of applications and the distance between the points it is anchored to may vary between applications. A horizontal lifeline system that does not have an adjustable length or that allows only a limited adjustment to the length will not be usable in a variety of applications.

When a horizontal lifeline system is installed, an amount of pre-tension should be applied to hold the horizontal lifeline taut and prevent it from sagging. If the amount of tension applied is too low, the horizontal lifeline system will sag. Additionally, in an arrest event, a worker may fall further than intended, which could potentially lead to injuries. If the amount of tension applied is too high, the tension may trigger the energy absorber to deploy and the energy absorber would need to be replaced or a replacement horizontal lifeline system may need to be provided. Additionally, too high of a tension could reduce the lifespan of the horizontal lifeline system.

There is room for improvement in horizontal lifeline systems. There is also room for improvement in methods of adjusting horizontal lifeline systems.

SUMMARY

These needs and others are met by embodiments of the disclosed concept in which a horizontal lifeline system includes a rope length adjuster and a tension limiting ratchet to provide coarse and fine adjustment to length and tension. These needs and others are also met by a method of adjusting a horizontal lifeline system.

In accordance with one aspect of the disclosed concept, a horizontal lifeline system comprises: a first termination arrangement structured to attach to a first anchor point; a second termination arrangement structured to attach to a second anchor point; a horizontal lifeline cable coupled to the first termination arrangement; a rope length adjuster attached to the horizontal lifeline cable and having a housing through which the horizontal lifeline cable can be pulled to adjust the length of the horizontal lifeline system and apply tension to the horizontal lifeline cable; and a tension limiting ratchet coupled between the second termination arrangement and the rope length adjuster and being structured to be ratcheted to increase tension applied to the horizontal lifeline cable and to provide an indication and deter further ratcheting when the tension applied to the horizontal lifeline cable reaches a predetermined tension limit.

In accordance with another aspect of the disclosed concept, a method of adjusting a horizontal lifeline system comprises: providing a horizontal lifeline system including a horizontal lifeline cable, a rope length adjuster, and a tension limiting ratchet being structured to be ratcheted to increase tension applied to the horizontal lifeline cable and to provide an indication and deter further ratcheting when the tension applied to the horizontal lifeline cable reaches a predetermined tension limit; adjusting a length and tension of the horizontal lifeline system using the rope length adjuster; and ratcheting the tension limiting ratchet to increase the tension of the horizontal lifeline system to the predetermined tension limit.

In accordance with another aspect of the disclosed concept, a horizontal lifeline system comprises: a first termination arrangement structured to attach to a first anchor point; a second termination arrangement structured to attach to a second anchor point; webbing coupled to the first termination arrangement; and a tension limiting ratchet coupled between the second termination arrangement and the webbing and being structured to be ratcheted to increase tension applied to the webbing and to provide an indication and deter further ratcheting when the tension applied to the webbing reaches a predetermined tension limit.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
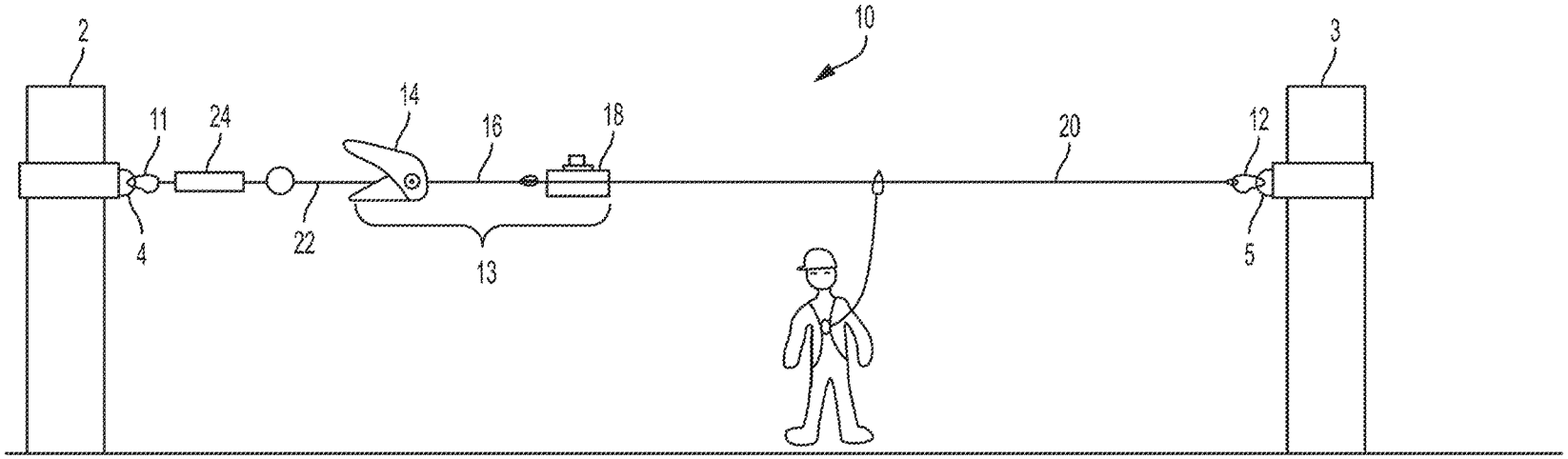
FIG. 1 is a view of a horizontal lifeline system in accordance with an example embodiment of the disclosed concept.

Directional phrases used herein, such as, for example, left, right, front, back, top, bottom and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

FIG. 1 is an illustration of a horizontal lifeline system 10 in accordance with an example embodiment of the disclosed concept. The horizontal lifeline system 10 includes termination arrangements 11,12 structured to attach the horizontal lifeline system 10 between anchor points 4,5 on corresponding structures 2,3. The anchor points 4,5 may be located on, for example and without limitation, permanent structures 2,3 such as a building or other construction. The anchor points may also be located on temporary structures attached to another structure to provide a place to attach the horizontal lifeline system 10. The anchor points 4,5 may include, for example and without limitation, a ring, an eyelet, a bracket, a post, a strap, or any other mechanism that provides a place to attach the horizontal lifeline system 10 to the corresponding structures 2,3. While some examples of anchor points 4,5 have been provided, it will be appreciated by those having ordinary skill in the art that any suitable anchor point may be employed in conjunction with the horizontal lifeline system 10 without departing from the scope of the disclosed concept.

The horizontal lifeline system 10 includes termination arrangements 11,12 provided at each of its ends. The termination arrangements 11,12 are structured to attach to corresponding anchor points 4,5. The termination arrangements 11,12 may include, for example and without limitation, hooks, carabiners, rings, etc. While some examples of termination arrangements 11,12 have been provided, it will be appreciated by those having ordinary skill in the art that any suitable termination arrangements that are capable of attaching the horizontal lifeline system 10 to corresponding anchor points 4,5 may be employed without departing from the scope of the disclosed concept.

The horizontal lifeline system 10 further includes a tensioning arrangement 13 and a horizontal lifeline cable 20. The tensioning arrangement 13 and the horizontal lifeline cable 20 are disposed between the termination arrangements 11,12. One end of the tensioning arrangement 13 is attached to the horizontal lifeline cable 20. The tensioning arrangement 13 is coupled, either directly, or indirectly via one or more additional components, to one of the termination arrangements 12. The horizontal lifeline cable 20 is coupled, either directly, or indirectly via one or more additional components, to the other of the termination arrangements 11.

Figure 2:
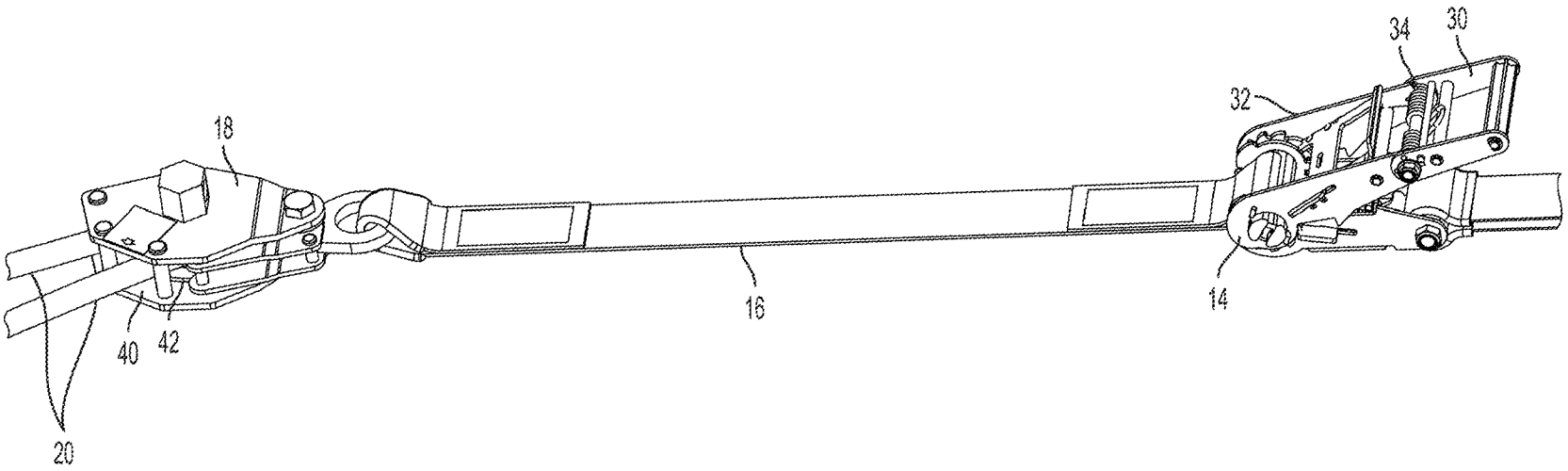
FIG. 2 is a view of a tensioning arrangement in accordance with an example embodiment of the disclosed concept.

The tensioning arrangement 13 is structured to provide tension for the horizontal lifeline cable 20. An example embodiment of the tensioning arrangement 13 is shown in more detail in FIG. 2. Referring to FIG. 2, the tensioning arrangement 13 includes a tension limiting ratchet 14 and a rope length adjuster 18. The tension limiting ratchet 14 is attached to the rope length adjuster 18 via webbing 16.

The tension limiting ratchet 14 is structured to ratchet to increase tension on the horizontal lifeline cable 20. The tension limiting ratchet 14 may be operated by a technician or other user of the horizontal lifeline system 10 without tools to increase the tension on the horizontal lifeline cable 20. The tension limiting ratchet 14 is also structured to limit the amount of tension it may apply by providing an indication and deterring further ratcheting when a predetermined tension limit associated with the tension limiting ratchet 14 has been reached.

The tension limiting ratchet 14 is also structured to provide an indication when the predetermined tension has been reached. The indication may be a tactile and/or visual indication that the predetermined tension has been reached. In some example embodiments of the disclosed concept, the tension limiting ratchet 14 has an upper ratchet handle 30 and a lower ratchet handle 32. A spring arrangement 34 is provided between the upper ratchet handle 30 and the lower ratchet handle 32. The spring arrangement 34 is structured to maintain the upper ratchet handle 30 and the lower ratchet handle 34 in an aligned position while the tension limiting ratchet 14 is being ratcheted. The spring arrangement 34 is structured such that when the predetermined tension limit has been reached, the force applied to the upper ratchet handle 30 to ratchet the tension limiting ratchet 14 will overcome the force applied by the spring arrangement 34 and the spring arrangement 34 will release and allow the upper ratchet handle 30 to rotate with respect to the lower ratchet handle 32. When the upper ratchet handle 30 rotates with respect to the lower ratchet handle 32, the tension limiting ratchet 14 is not able to be properly ratcheted further so that the tension it applies to the horizontal lifeline cable 20 will not be further increased. The upper ratchet handle 30 rotating with respect to the lower ratchet handle 32 also provides a tactile and visual indication that the predetermined tension limit has been reached.

Figure 3:
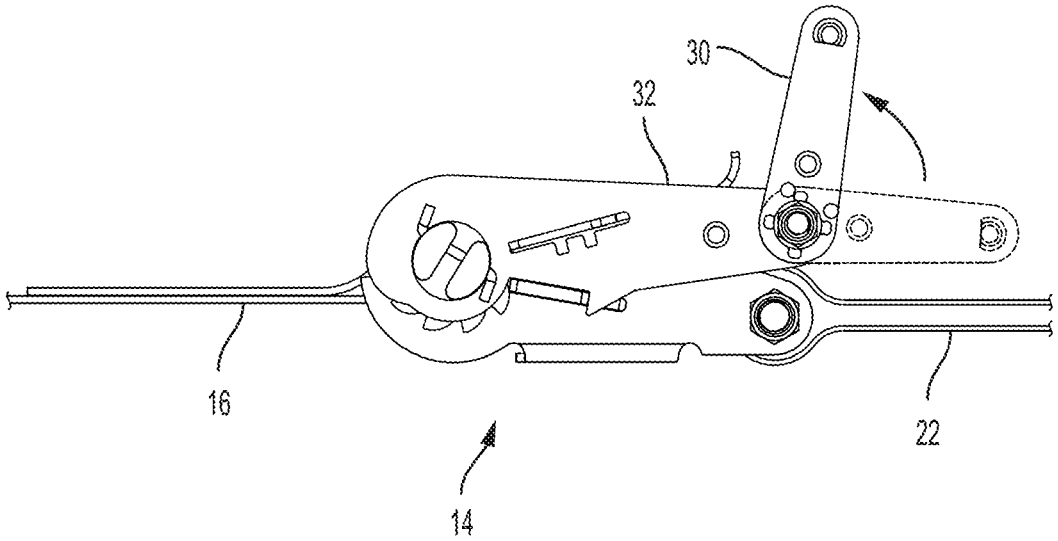
FIG. 3 is a view of a tension limiting ratchet reaching its predetermined tension limit in accordance with an example embodiment of the disclosed concept.

An example of the tension limiting ratchet 14 reaching the predetermined tension limit is shown in FIG. 3. As is shown in FIG. 3, when the tension limiting ratchet 14 reaches the predetermined tension limit, the upper ratchet handle 30 is allowed to rotate with respect to the lower ratchet handle 32. Once the upper ratchet handle 30 has been released, further attempts to perform a normal ratchet operation will result in the upper ratchet handle 30 rotating with respect to the lower ratchet handle 32 rather than the tension limiting ratchet 14 ratcheting in the webbing 16 further.

It will be appreciated by those having ordinary skill in the art that any suitable type of tension limiting ratchet may be employed without departing from the scope of the disclosed concept. For example and without limitation, a tension limiting ratchet such as the one described in WO 2008/057124, the entire disclosure of which is hereby incorporated by reference, may be employed as the tension limiting ratchet 14 in the presently disclosed concept. It will also be appreciated that other types of suitable tension limiting ratchets may be employed without departing from the scope of the disclosed concept. Furthermore, while one example of a type of indication provided when the tension limiting ratchet 14 has reached the predetermined tension limit has been described, it will be appreciated that other types of indication may be provided without departing from the scope of the disclosed concept. For example and without limitation, a visual indicator may pop out of the tension limiting ratchet 14 when the predetermined tension has been reached.

Referring back to FIG. 2, webbing 16 is provided between the tension limiting ratchet 14 and the rope length adjuster 18. The webbing 16 is attached to both the tension limiting ratchet 14 and the rope length adjuster 18 and serves to couple these components together. The webbing 16 also provides an amount of webbing usable in the ratcheting process of the tension limiting ratchet 14. For example, an amount of the webbing 16 is wound into the tension limiting ratchet 14 as it is ratcheted to increase the tension applied to the horizontal lifeline cable 20.

The rope length adjuster 18 is attached to the horizontal lifeline cable 20. The rope length adjuster 18 includes a housing 40 through which an end of the horizontal lifeline cable 20 can be threaded. A pulley arrangement 42 within the rope length adjuster 18 facilitates pulling the horizontal lifeline cable 20 through the housing 40. Pulling the horizontal lifeline cable 20 through the rope length adjuster 18 adjusts the end to end length of the horizontal lifeline system 10. Additionally, pulling the horizontal lifeline cable 20 through the rope length adjuster 18 applies tension to the horizontal lifeline cable 20. Once the horizontal lifeline cable 20 is pulled through the rope length adjuster 18 to adjust the length of the horizontal lifeline system 10 and apply a desired amount of tension to the horizontal lifeline cable 20, the horizontal lifeline cable 20 is tied off.

Applying tension via pulling the horizontal lifeline cable 20 through the rope length adjuster 18 provides a coarse amount of tension to the horizontal lifeline cable 20. In other words, the amount of tension applied is not precise. Too low of tension can cause excessive fall distance in an arrest event and too high of tension can cause the energy absorber 24 to deploy prematurely. In the horizontal lifeline system in accordance with some example embodiments of the disclosed concept, the tension limiting ratchet 14 allows for finer adjustments to the tension of the horizontal lifeline cable 20 and a clear indication when the predetermined tension limit has been reached. The tension limiting ratchet 14 alone does not provide for coarse length adjustment or an initial coarse tension setting. Providing both the tension limiting ratchet 14 and the rope length adjuster 18 in the horizontal lifeline system 10 allows both coarse adjustments to length and tension which allow the horizontal lifeline system 10 to be used in a variety of application and precise tension setting which ensures that the horizontal lifeline system 10 will not be susceptible to issues arising from improper tension.

Referring back to FIG. 1, the horizontal lifeline system 10 may include additional components. For example and without limitation, an energy absorber 24 may be provided in the horizontal lifeline system 10. The energy absorber 24 is structured to deploy in the case of an arrest event. The energy absorber 24 limits the maximum arrest load. Any known or suitable energy absorber may be employed in conjunction with the disclosed concept. The energy absorber 24 may be attached at any suitable point along the horizontal lifeline system 10 without departing from the scope of the disclosed concept. For example, the energy absorber 24 may be attached to one of the termination arrangements 11,12.

The horizontal lifeline system 10 may include a second webbing 22. The second webbing 22 may be attached to the tension limiting ratchet 14 and may couple the tension limiting ratchet 14 to one of the termination arrangements 11,12 either directly or indirectly. It will be appreciated that a rope, a cable, or another attachment mechanism may replace the second webbing 22 without departing from the scope of the disclosed concept.

It will be appreciated by those having ordinary skill in the art that the horizontal lifeline cable 20 may be composed of any suitable material. For example and without limitation, in some example embodiments of the disclosed concept, the horizontal lifeline cable 20 may be a rope composed of fabric and/or polymer materials. However, it will also be appreciated by those having ordinary skill in the art that other suitable materials may be employed in the horizontal lifeline cable 20 without departing from the scope of the disclosed concept.

Figure 4:
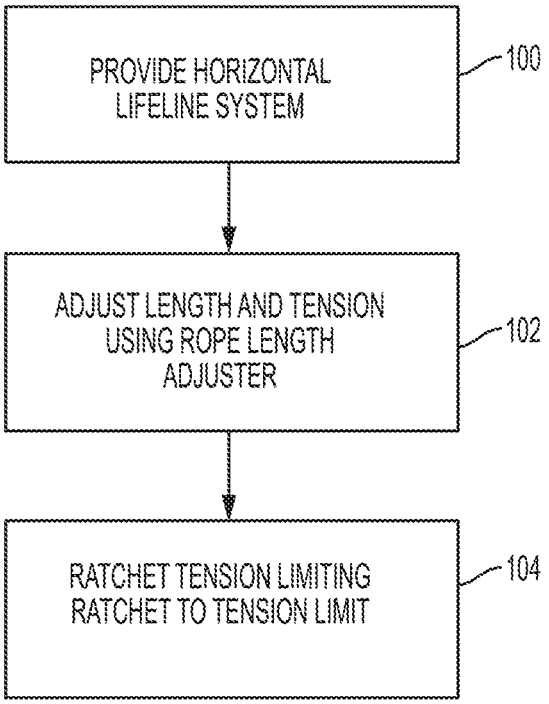
FIG. 4 is a flowchart of a method of adjusting a horizontal lifeline system in accordance with an example embodiment of the disclosed concept.

FIG. 4 is a flowchart of a method of adjusting a horizontal lifeline system in accordance with an example embodiment of the disclosed concept. The method begins with providing a horizontal lifeline system 10 including a tension limiting ratchet 14, a rope length adjuster 18, and a horizontal lifeline cable 20 at 100. The horizontal lifeline system 10 may be the same or similar to the horizontal lifeline system 10 shown in and described with respect to FIG. 1. At 102, the length and tension of the horizontal lifeline system 10 are adjusted using the rope length adjuster 18. For example, the horizontal lifeline cable 20 is threaded through the rope length adjuster 18. The length and tension are adjusted by pulling the horizontal lifeline cable 20 through the rope length adjuster 18. When the desired length and tension are reached, the horizontal lifeline cable 20 is tied off. At 104, the tension limiting ratchet 14 is ratcheted until the tension in the horizontal lifeline cable 20 reaches the predetermined tension limit associated with the tension limiting ratchet. As previously described, the tension limiting ratchet 14 may provide an indication and deter further ratcheting when the predetermined tension limit is reached. In accordance with some example embodiments of the disclosed concept, the method allows the tension of the horizontal lifeline to be precisely set to the predetermined tension.

In some example embodiments of the disclosed concept, the method of FIG. 4 may also include checking the tension of the horizontal lifeline system 10 an amount of time after the horizontal lifeline system 10 has initially been adjusted. The tension of the horizontal lifeline system 10 may be checked by ratcheting the tension limiting ratchet 14 until it provides the indication that the predetermined tension limit has been reached and deters further ratcheting. Over time, the tension in the horizontal lifeline system 10 may be reduced, so it is useful to check its tension from time to time. It is also useful to check its tension before use. The tension limiting ratchet 14 provides a way to quickly check and adjust the tension of the horizontal lifeline system 10 without the need for any extra tools.

Figure 5:
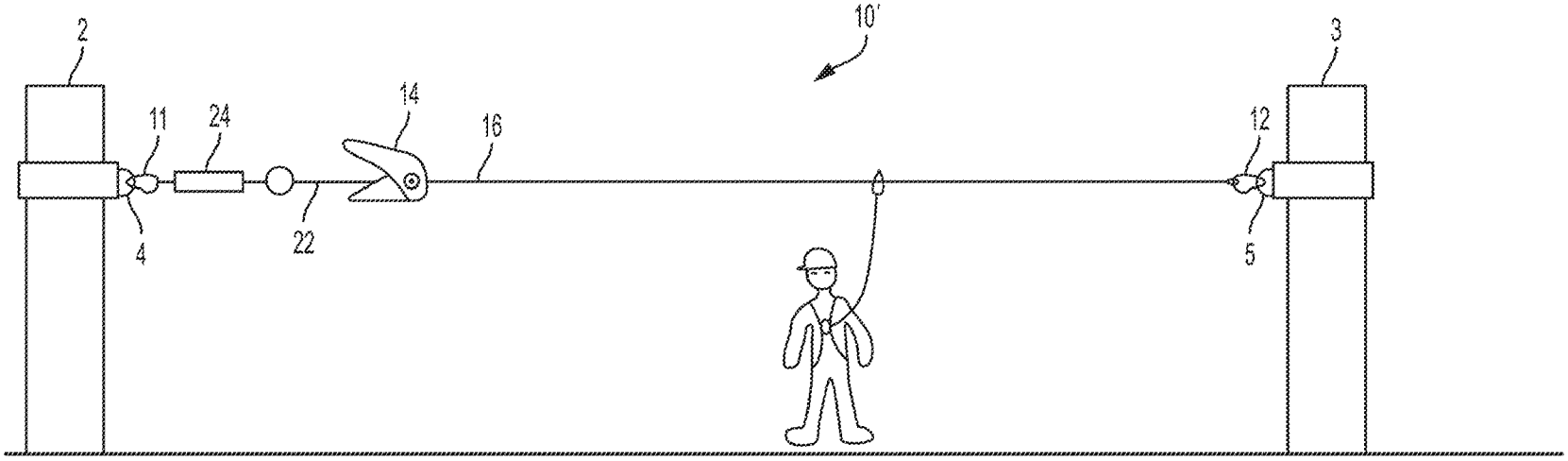
FIG. 5 is a view of a horizontal lifeline system in accordance with another example embodiment of the disclosed concept.

FIG. 5 is a view of a horizontal lifeline system 10' in accordance with another example embodiment of the disclosed concept. The horizontal lifeline system 10' of FIG. 5 is similar to the horizontal lifeline system 10 of FIG. 1. However, in the horizontal lifeline system 10' of FIG. 5, the rope length adjuster 18 and the horizontal lifeline cable 20 are omitted. Instead, the webbing 16 extends from the tension limiting ratchet 16 to the one of the termination arrangements 12. In the example embodiment of FIG. 5, the webbing 16 serves as a horizontal lifeline cable. The webbing 16 is coupled to the termination arrangement 12 and the tension limiting ratchet 14 is coupled between the other termination arrangement 11 and the webbing 16. The tension limiting ratchet 14 is structured to be ratcheted to increase tension applied to the webbing 16 and to provide an indication and deter further ratcheting when the tension applied to the webbing 16 reaches a predetermined tension limit. It will be appreciated by those having ordinary skill in the art that the arrangement of the elements of the horizontal lifeline system 10' may be altered without departing from the scope of the disclosed concept.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

In some example embodiments of the disclosed concept, the energy absorber 24 is structured to deploy at a deployment tension and the predetermined tension limit associated with the tension limiting ratchet 14 is less than the deployment tension.

What is claimed is:

1. A horizontal lifeline system comprising:

a first termination arrangement structured to attach to a first anchor point;

a second termination arrangement structured to attach to a second anchor point;

a horizontal lifeline cable coupled to the first termination arrangement;

a rope length adjuster attached to the horizontal lifeline cable and having a housing through which the horizontal lifeline cable can be pulled to adjust the length of the horizontal lifeline system and apply tension to the horizontal lifeline cable;

a tension limiting ratchet coupled between the second termination arrangement and the rope length adjuster and being structured to be ratcheted to increase tension applied to the horizontal lifeline cable and to provide an indication and deter further ratcheting when the tension applied to the horizontal lifeline cable reaches a predetermined tension limit; and webbing having a first end attached to the tension limiting ratchet and a second end directly attached to the rope length adjuster, wherein the tension limiting ratchet is structured to pull in the webbing when the tension limiting ratchet is ratcheted.

2. The horizontal lifeline system of claim 1, further comprising:

a second webbing coupled between the tension limiting ratchet and one of the first and second termination arrangements.

3. The horizontal lifeline system of claim 1, wherein the tension limiting ratchet includes:

an upper handle;

a lower handle attached to the upper handle; and a spring arrangement structured to hold the upper handle and the lower handle in alignment with each other while the tension applied to the horizontal lifeline cable is below the predetermined tension limit and to release and allow the upper handle to rotate with respect to the lower handle when the tension applied to the horizontal lifeline cable is above the predetermined tension limit.

4. The horizontal lifeline system of claim 1, wherein the tension limiting ratchet is structured to provide a visual or tactile indication when the tension applied to the horizontal lifeline cable reaches the predetermined tension limit.

5. The horizontal lifeline system of claim 1, further comprising:

an energy absorber coupled between the first and second termination arrangements, wherein the energy absorber is structured to deploy during an arrest event.

6. The horizontal lifeline system of claim 5, wherein the energy absorber is structured to deploy at a predetermined tension, and wherein the predetermined tension limit is less than the predetermined tension.

7. The horizontal lifeline system of claim 1, wherein the horizontal lifeline cable is a rope composed of fabric or polymer material.

8. The horizontal lifeline system of claim 1, wherein the first and second termination arrangements include at least one of a hook, a carabiner, or a ring.

9. A method of adjusting a horizontal lifeline system, the method comprising:

providing a horizontal lifeline system including a horizontal lifeline cable, a rope length adjuster, and a tension limiting ratchet being structured to be ratcheted to increase tension applied to the horizontal lifeline cable and to provide an indication and deter further ratcheting when the tension applied to the horizontal lifeline cable reaches a predetermined tension limit;

adjusting a length and tension of the horizontal lifeline system using the rope length adjuster; and ratcheting the tension limiting ratchet to increase the tension of the horizontal lifeline system to the predetermined tension limit.

10. The method of claim 9, wherein adjusting the length and tension of the horizontal lifeline system using the rope length adjuster includes threading the horizontal lifeline cable through a housing of the rope length adjuster and pulling the horizontal lifeline cable through the housing of the rope length adjuster to shorten the length and increase the tension of the horizontal lifeline system.

11. The method of claim 9, further comprising:

waiting an amount of time and checking and re-adjusting the tension of the horizontal lifeline system by ratcheting the tension limiting ratchet until the tension limiting ratchet provides the indication and deters further ratcheting.

12. The method of claim 9, wherein the tension limiting ratchet includes:

an upper handle;

a lower handle attached to the upper handle; and a spring arrangement structured to hold the upper handle and the lower handle in alignment with each other while the tension applied to the horizontal lifeline cable is below the predetermined tension limit and to release and allow the upper handle to rotate with respect to the lower handle when the tension applied to the horizontal lifeline cable is above the predetermined tension limit.

13. The method of claim 9, wherein the tension limiting ratchet is structured to provide a visual and/or tactile indication when the tension applied to the horizontal lifeline cable reaches the predetermined tension limit.

14. The method of claim 9, wherein the horizontal lifeline system further includes webbing coupled between the tension limiting ratchet and the rope length adjuster, wherein the tension limiting ratchet is structured to pull in the webbing when the tension limiting ratchet is ratcheted.

* * * * *